US006113477A

United States Patent [19]

Arai

[11] Patent Number: 6,113,477

[45] Date of Patent: Sep. 5, 2000

[54] DRILL ABRASIVE APPARATUS

[76] Inventor: Koichi Arai, 8-8, Hiezu, Hiezu-son, Saihaku-gun, Tottori 689-3553, Japan

[21] Appl. No.: 09/269,616

[22] PCT Filed: Nov. 14, 1997

[86] PCT No.: PCT/JP97/04166

§ 371 Date: Mar. 26, 1999

§ 102(e) Date: Mar. 26, 1999

[87] PCT Pub. No.: WO99/28082

PCT Pub. Date: Oct. 6, 1999

[51] Int. Cl.[7] ..... B24B 5/00

[52] U.S. Cl. ..... 451/241; 457/178; 457/375; 457/143; 457/242; 457/411

[58] Field of Search ..... 451/48, 241, 242, 451/128, 325, 143, 411

[56] References Cited

U.S. PATENT DOCUMENTS

| | | | |
|---|---|---|---|
| 3,126,679 | 3/1964 | Abadjieff | 451/375 |
| 3,584,420 | 6/1971 | Southland | 451/375 |
| 3,916,570 | 11/1975 | Caley | 451/375 |
| 4,455,786 | 6/1984 | Maysilles | 451/143 |
| 4,471,581 | 9/1984 | Bernard et al. | 451/143 |
| 5,400,546 | 3/1995 | Christian et al. | 451/143 |
| 5,735,732 | 4/1998 | Bernard | 451/178 |

*Primary Examiner*—David A. Scherbel
*Assistant Examiner*—George Nguyen
*Attorney, Agent, or Firm*—Curtis L. Harrington

[57] ABSTRACT

A drill abrasive apparatus, capable of grinding a candle-shaped drill requiring Z-type thinning, has a whetstone (1), a drill holder (5), a drill adjustable pedestal (2), a drill abrasive pedestal (3) and a drill thinning pedestal (4). An abrasive surface of the whetstone has a parallel surface (11) parallel with a rotating axis of the whetstone, a relief surface (12) for a chisel portion central to of the drill in front of the parallel surface, a slanted surface (13) for a thinning behind the parallel surface for a predetermined angle, and a second parallel surface (14) behind the slanted surface parallel with the rotating axis of the whetstone. The drill holder a cylindrical drill insertion portion (51), holder ring (52) with guide groove **(52*e*) regulating a rotating angle of the drill holder mounted to the drill insertion portion for a cutting edge-shape. The drill adjustable pedestal has a fitting hole (21*a*) into which the drill insertion portion is fitted, an adjustable base pedestal (21) having a latch projection for determining an angle and position of the drill holder, and a stopper (22) integral with the adjustable base pedestal. The drill abrasive pedestal has a fitting hole (31) into which the drill insertion portion is fitted and a latch projection (31*a*), inserted into the guide groove with play existing therebetween, is provided on the peripheral edge portion. The drill thinning pedestal has a fixing leg (41) fixed to a base (8) and a fitting portion (42) mounted to the fixing leg and has a fitting hole (42*a*)** into which the drill insertion portion is fitted, and the fitting portion has a latch projection for determining the angle and position of the drill holder and can be slanted towards the whetstone within a predetermined angle range.

1 Claim, 16 Drawing Sheets

DRILL ABRASIVE APPARATUS

FIELD OF THE INVENTION

The present invention relates to a drill abrasive apparatus which is capable of grinding a candle-shaped drill requiring Z-type thinning.

BACKGROUND OF THE INVENTION

In general, in order to remove a spot-welded portion to be used for a body panel or the like of a vehicle, as shown in FIG. 28, a so-called candle-type drill, in which a central portion of a point of a drill is formed into an angle-shaped and projected portion and an outer peripheral portion is formed into a substantially plane shape, is used.

This is because in the case where a drill with a point angle of 118° to be used generally is used, the point of the drill pierces into a spot-welded portion, and a hole is made not only in a panel which is desired to be replaced but also in a panel which is desired to remain. On the contrary, when the candle-type drill is used, only a projection of the point of the drill cuts into the welded portion and thus a cutting center is achieved, and the welded portion is cut by a cutting edge on the outer side of the projection so as to be removed. For this reason, an unnecessary hole is not made.

However, since the spot-welded portion is brought into a kind of a quenched state at the time of deposition, this portion is harder than the other portion of the panel, and a boring machine such as a drilling machine cannot be used for a spot-welding removal work and thus a hand drill is used. For this reason, it is necessary to give a so-called thinning process for making a chisel width to be small so as to form a cutting edge at the central portion of the drill is given to a drill to be used for the spot-welding removal work.

Conventionally, this thinning process has been performed manually by using a bench abrasive machine, but since a very skilled technique has been required for the thinning process, it was difficult to perform the thinning process accurately for a short time.

From this point of view, the inventor of this application has suggested a drill abrasive apparatus having a thinning mechanism in Japanese Utility Model Application Laid-Open No. 7-15247 (1995).

This drill abrasive apparatus was extremely excellent in that the thinning process can be performed by a simple operation without requiring a skilled technique, but this abrasive apparatus could not form a thinning shape (Z-type thinning) which is the most suitable for the above-mentioned spot-welding removal because of problems of a whetstone shape and a positional relationship between the drill and the whetstone and the like.

The present invention is devised in order to solve the above problems, and its object is to provide a drill abrasive apparatus which is capable of being used suitably for removal of spot-welding to be used for a body panel or the like of a vehicle and of grinding a candle-shaped drill requiring Z-type thinning.

DISCLOSURE OF THE INVENTION

The present invention provides a drill abrasive apparatus, which is capable of grinding a candle-shaped drill requiring Z-type thinning, including a whetstone, a drill holder, a drill adjustable pedestal, a drill abrasive pedestal and a drill thinning pedestal. The drill abrasive apparatus is constituted so that an abrasive surface of the whetstone is composed of a parallel surface formed parallel with a rotating axis of the whetstone, a relief surface for a chisel portion at a central portion of the drill formed in front of the parallel surface, a slanted surface for a thinning process formed behind the parallel surface so as to have a predetermined angle, and a second parallel surface formed behind the slanted surface so as to be parallel with the rotating axis of the whetstone, the drill holder is composed of a cylindrical drill insertion portion, and a holder ring which has a guide groove for regulating a rotating angle of the drill holder and is mounted to one end of the drill insertion portion so as to have an cutting edge-shape, the drill adjustable pedestal is composed of a fitting hole into which the drill insertion portion can be fitted, an adjustable base pedestal having a latch projection for determining an angle and position of the drill holder, and a stopper which is mounted on a forward side of the fitting hole so as to be integral with the adjustable base pedestal, the drill abrasive pedestal is composed of a fitting hole into which the drill insertion portion can be fitted and when the drill insertion portion is inserted into the fitting hole until the holder ring of the drill holder comes in contact with a peripheral edge portion of the fitting hole, the cutting edge of the drill comes in contact with the abrasive surface of the whetstone and a latch projection, which is inserted into the guide groove with a play existing therebetween, is provided on the peripheral edge portion, the drill thinning pedestal is composed of a fixing leg fixed to a base and a fitting portion which is mounted to the fixing leg and has a fitting hole into which the drill insertion portion can be fitted, the fitting portion has a latch projection for determining the angle and position of the drill holder and can be slanted towards the whetstone within a predetermined angle range. Therefore, the point of the drill can be brought into contact with the abrasive surface of the whetstone at an angle required for forming Z-type thinning accurately by a simple operation, and the candle-shaped drill requiring the Z-type thinning can he ground easily.

DETAILED DESCRIPTION OF THE PREFERRED EMBODIMENTS

The following will describe a drill abrasive apparatus according to preferred embodiments of the present invention with reference to the drawings.

Figure 1:
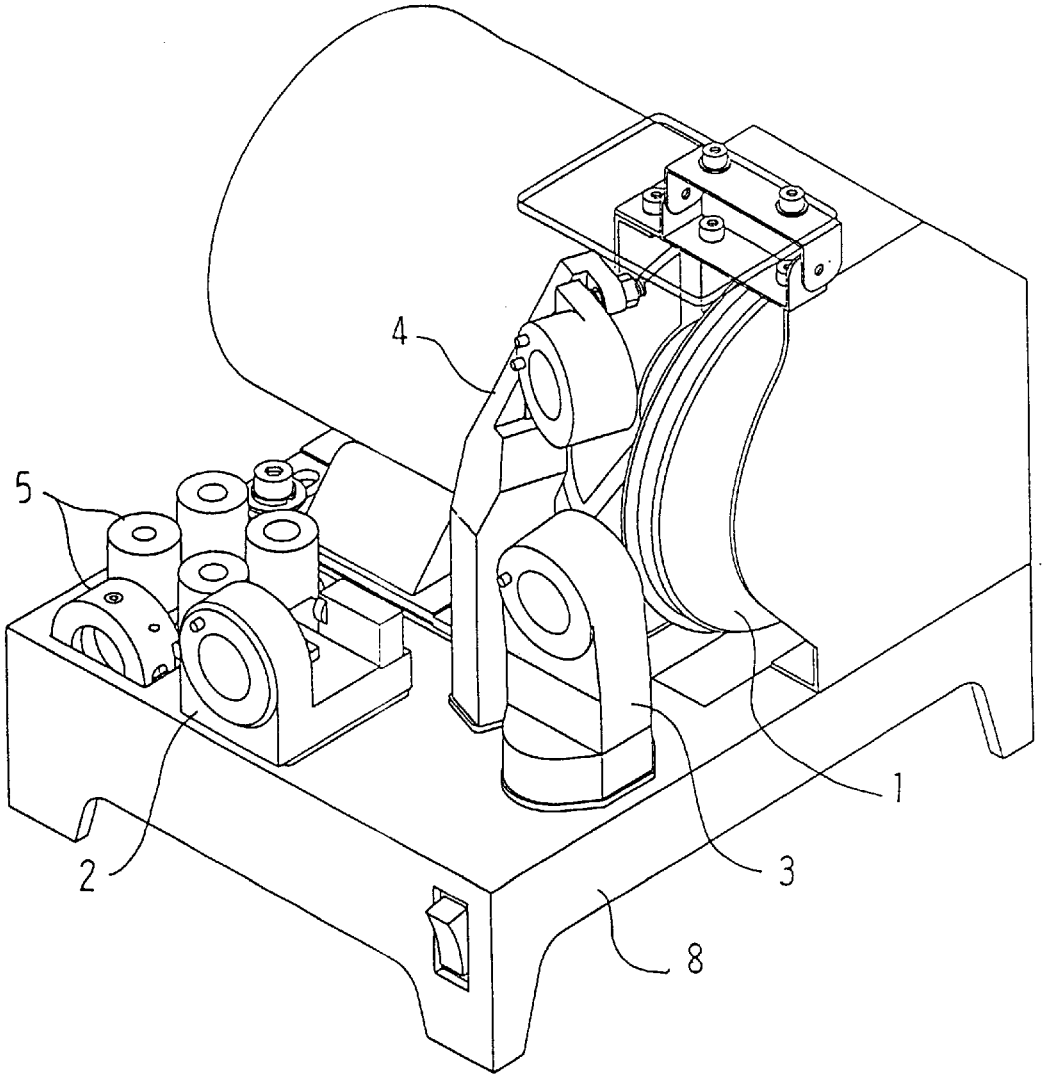
FIG. 1 is a perspective view showing a whole constitution of a drill abrasive apparatus according to the present invention.

FIG. 1 is a perspective view showing a whole constitution of the drill abrasive apparatus according to the present invention.

The drill abrasive apparatus according to the present invention is mainly composed of a whetstone 1 positioned on a base 8, a drill adjustable pedestal 2, a drill abrasive pedestal 3, a drill thinning pedestal 4 and a drill holder 5.

Figure 2:
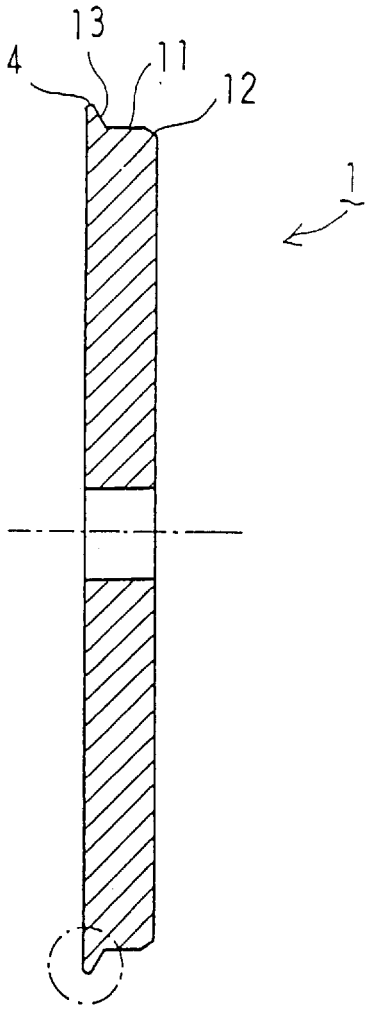
FIG. 2 is a sectional view showing a whetstone.
Figure 3:
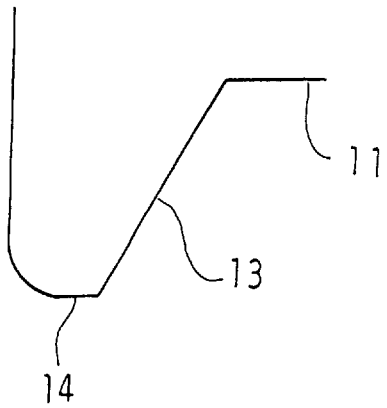
FIG. 3 is an enlarged view of a circled portion of FIG. 2.

FIG. 2 is a sectional view showing the whetstone 1, and FIG. 3 is an enlarged view of a circled portion of FIG. 2.

An abrasive surface of the whetstone 1 has, as shown in the drawings, a parallel surface 11 formed parallel with a whetstone rotating axis (represented by an alternate long and short dash line), a relief surface 12 which is formed in front of the parallel surface 11 and is a relief portion of a chisel at a central portion of the drill, a slanted surface 13 which is formed behind the parallel surface 11 so as to have a predetermined angle and is used for a thinning process, and a second parallel surface 14 which is formed behind the slanted surface 13 so as to be parallel with the whetstone rotating axis.

Oblique angles of the relief surface 12 and slanted surface 13 with respect to the parallel surface 11 are set respectively to 35° and 30°, and a radius is given to a backward end of the second parallel surface 14, namely, a backward-most portion of the whetstone 1.

A CBN#170 electrodeposition whetstone is suitably used as the whetstone 1, but the whetstone 1 is not particularly limited to this.

Figure 4:
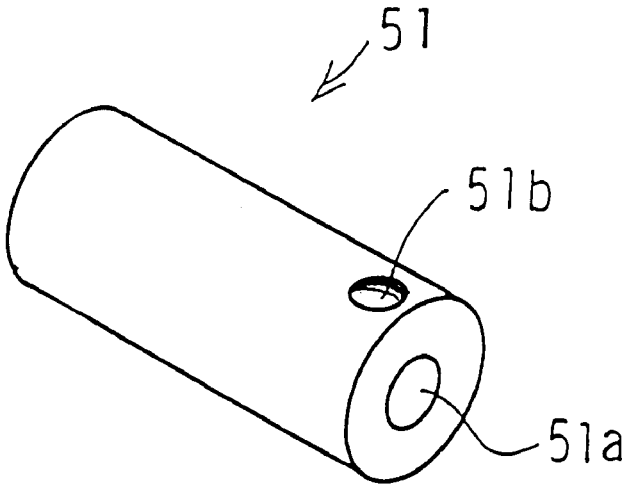
FIG. 4 is a perspective view showing a drill insertion portion.
Figure 5:
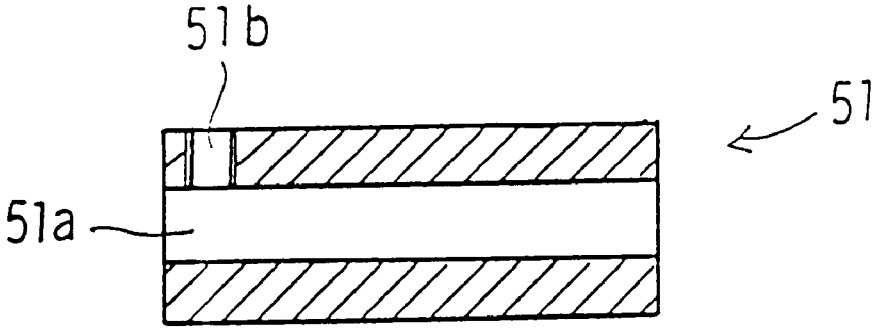
FIG. 5 is a sectional view showing the drill insertion portion.

FIG. 4 is a perspective view showing a drill insertion portion 51 composing the drill holder 5 for holding a drill, and FIG. 5 is a sectional view showing the drill insertion portion 51.

As shown in the drawings, the drill insertion portion 51 has a cylindrical shape such that an insertion hole 51*a* according to a drill diameter is formed, and a tapped hole 51*b* of a radial direction is formed from an outer surface towards the insertion hole 51*a*. Here, as shown in FIG. 1, the drill insertion portion 51 is provided with a plurality of the insertion holes 51*a* with different diameters.

Figure 6:
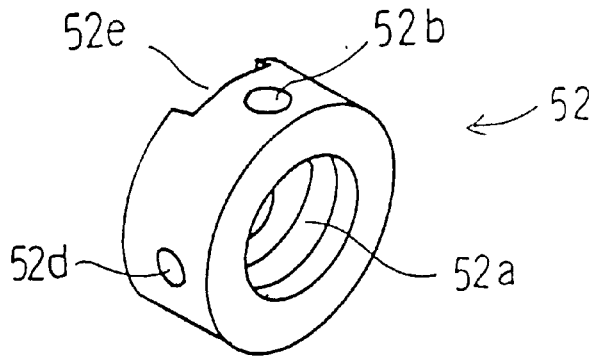
FIG. 6 is a perspective view showing a holder ring.
Figure 7:
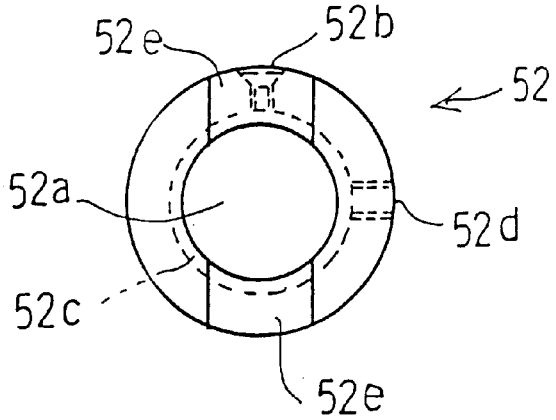
FIG. 7 is a front view showing the holder ring.
Figure 8:
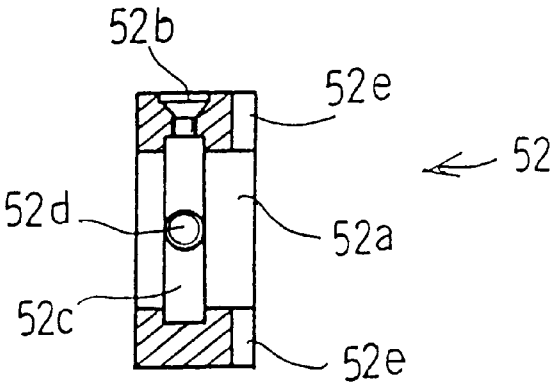
FIG. 8 is a sectional view showing the holder ring.

FIG. 6 is a perspective view showing a holder ring 52 composing the drill holder 5, FIG. 7 is a front view showing the holder ring 52 and FIG. 8 is a sectional view showing the holder ring 52.

The holder ring 52 has a fitting hole 52*a* into which the drill insertion portion 51 is fitted, and a large-diameter portion 52*c* is formed in a midway portion of the fitting hole 52*a*. Then, tapped holes 52*b* and 52*d* of a radial direction are formed from the outer surface towards the large-diameter portion 52*c* so as to satisfy a relationship where they make an angle of 90°. Moreover, a pair of guide grooves 52*e* are formed in the radial direction on one surface of the holder ring 52. The width of these guide grooves 52*e* is set according to a cutting range of the cutting edge of the drill.

Figure 9:
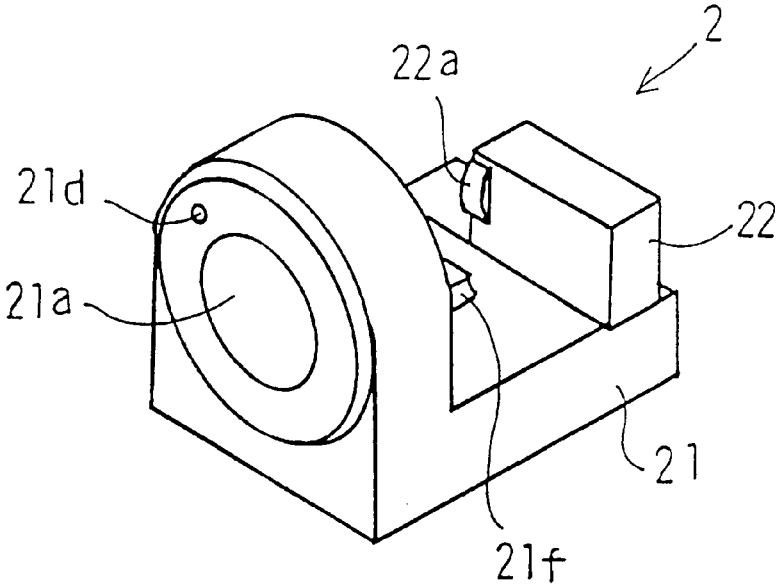
FIG. 9 is a perspective view showing a drill adjustable pedestal.

FIG. 9 is a perspective view showing the drill adjustable pedestal 2, and the drill adjustable pedestal 2 is composed of an adjustable base pedestal 21 to be fixed onto the base 8, and a stopper 22 fixed onto the adjustable base pedestal 21.

Figure 10:
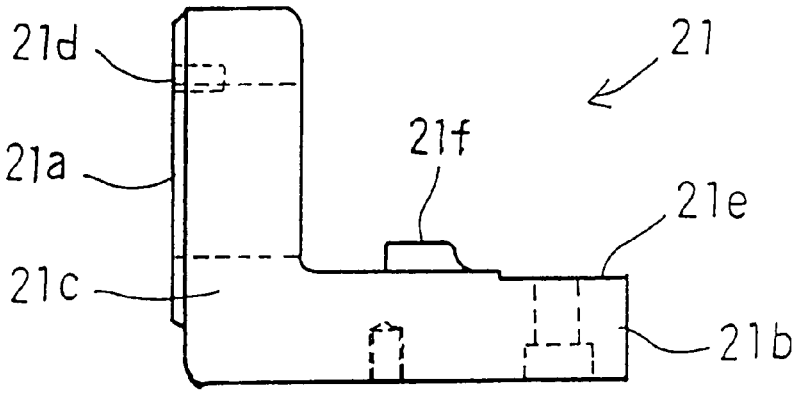
FIG. 10 is a front view showing an adjustable base pedestal.
Figure 11:
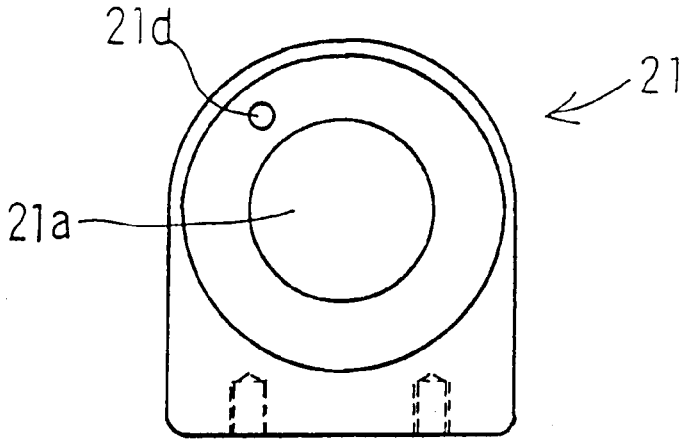
FIG. 11 is a left side view showing the adjustable base pedestal.
Figure 12:
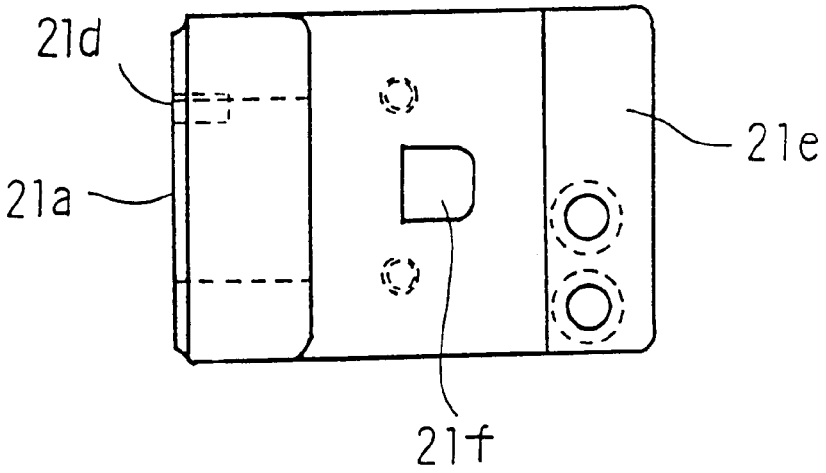
FIG. 12 is an upper surface view showing the adjustable base pedestal.

FIGS. 10 through 12 are respectively a front view, a left side view and an upper surface view showing the adjustable base pedestal 21.

The adjustable base pedestal 21 is formed by a horizontal portion 21*b* and a vertical portion 21*c* as shown in FIG. 10, and a fitting hole 21*a* into which the drill insertion portion 51 can be fitted is formed on the vertical portion 21*c*, and a small hole 21*d* is bored in a peripheral edge portion of the fitting hole 21*a*. A pin (not shown) is inserted into the small hole 21*d* so as to projected therefrom, and this pin serves as a latch projection for determining an angle and position of the drill holder as mentioned later.

A fixing portion 21*e* of the stopper 22 is provided at the end of the horizontal portion 21*b*, and a projection 21*f* is formed in its midway portion. This projection 21*f* is formed so as to be higher than a lowest surface of the fitting hole 21*a* and serves as a stopper of the drill insertion portion 51 as mentioned later.

In addition, an arc-shaped projection 22*a* is formed on a surface which is counter to the vertical portion 21*c* of the adjustable base pedestal of the stopper 22 as shown in FIG. 9. This arc-shaped projection 22*a* determines the angle and position of the point of the drill.

Figure 13:
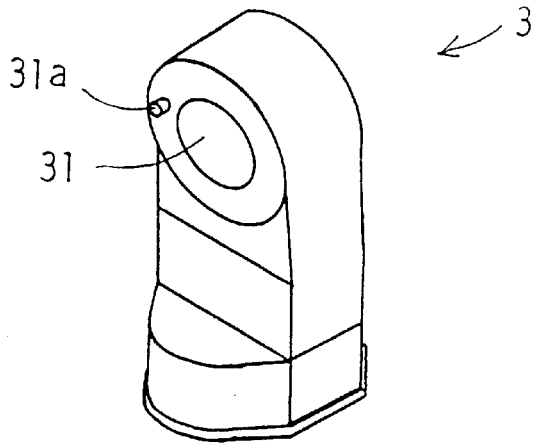
FIG. 13 is a perspective view showing a drill abrasive pedestal.

FIG. 13 is a perspective view showing the drill abrasive pedestal 3.

The drill abrasive pedestal 3 has a fitting hole 31 into which the drill insertion portion 51 can be fitted, and it is arranged so that when the drill insertion portion 51 is inserted into the fitting hole 31 until the holder ring 52 comes into contact with the peripheral edge portion of the fitting hole 31, the cutting edge of the drill comes into contact with the abrasive surface of the whetstone 1. Moreover, as shown in FIG. 1, while the drill abrasive pedestal 3 is fixed onto the base 8, the fitting hole 31 is slanted slightly upward, namely, towards the whetstone 1.

A small hole is bored in the peripheral edge portion of the fitting hole 31, and a pin is inserted into this small hole so that a latch projection 31*a* is formed. As mentioned later, this latch projection 31*a* is inserted into a guide groove 52*e* of the holder ring 52 in a state that a play is provided therebetween when the drill is ground.

As shown in FIG. 1, the drill thinning pedestal 4 is positioned in a vicinity of the drill abrasive pedestal 3 so as to face towards the whetstone 1 similarly to the drill abrasive pedestal 3.

The drill thinning pedestal 4 is composed of a fixing leg 41 fixed to a base plate, and a fitting portion 42 mounted to the fixing leg 41.

Figure 14:
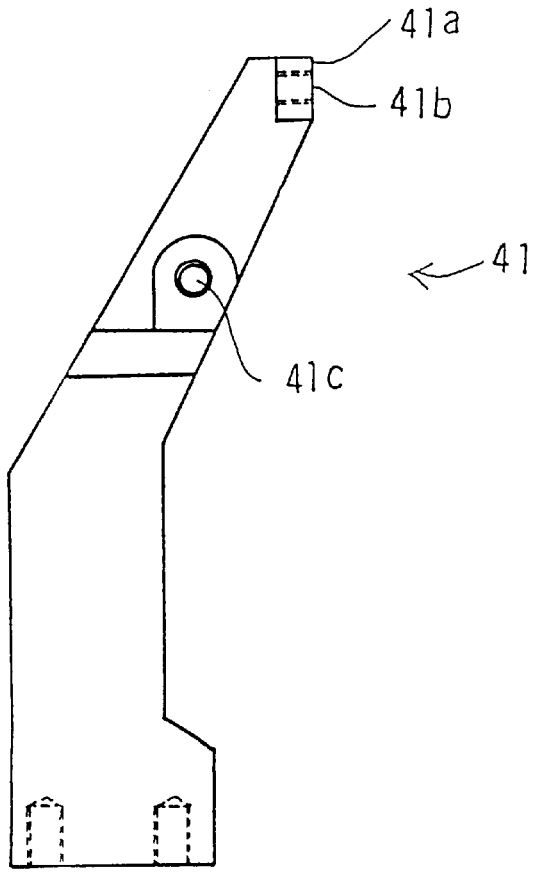
FIG. 14 is a front view showing a fixing leg.
Figure 15:
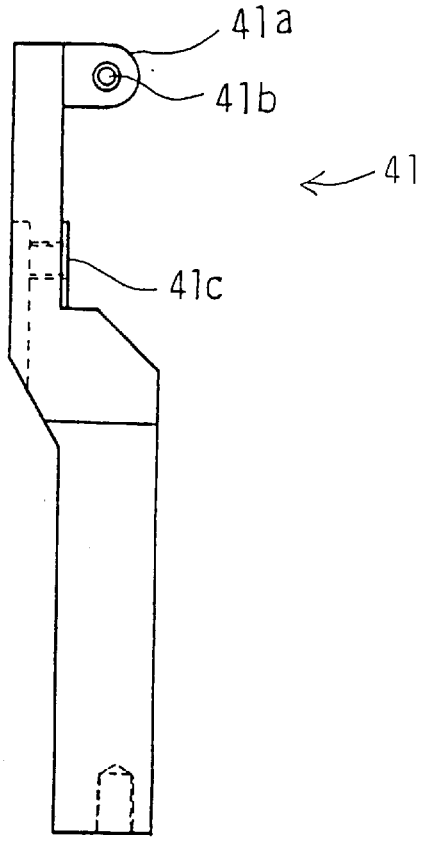
FIG. 15 is a side view showing the fixing leg.

FIG. 14 is a front view showing the fixing leg 41, and FIG. 15 is a side view showing the fixing leg 41.

An extended portion 41*a* is provided at a topmost portion of the fixing leg 41, and a tapped hole 41*b* is formed on the extended portion 41*a*. Moreover, a tapped hole 41*c* for mounting the fitting portion 42 is formed in the midway portion of the fixing leg 41.

Figure 16:
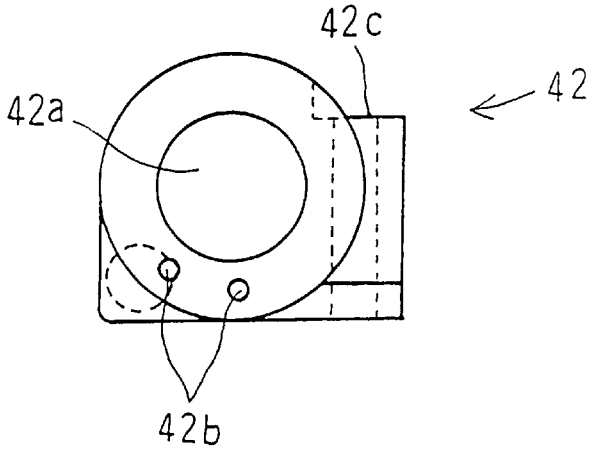
FIG. 16 is a front view showing a fitting portion to be mounted to the fixing leg.
Figure 17:
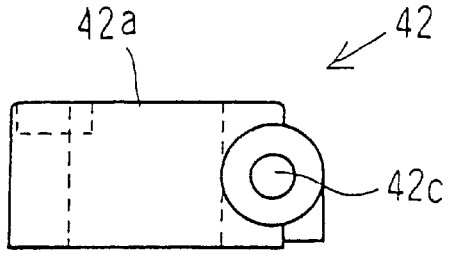
FIG. 17 is an upper side view showing the fitting portion.

FIG. 16 is a front view showing the fitting portion 42 to be mounted to the fixing leg 41, and FIG. 17 is an upper surface view showing the fitting portion 42.

The fitting portion 42 has a fitting hole 42*a* into which the drill insertion portion 51 can be fitted, and two small holes 42*b* are bored in a peripheral edge portion of the fitting hole 42*a*.

Pins are projected respective from these two small holes 42*b* so that two latch projections are formed. These two latch projections contact with both side walls of the guide grooves 52*e* of the holder ring 52 at the time of the thinning process so as to determine the angle and position of the drill holder 5.

In addition, a through hole 42*c* which is at right angles to the fitting hole 42*a* is provided on a side portion of the fitting portion 42.

Figure 18:
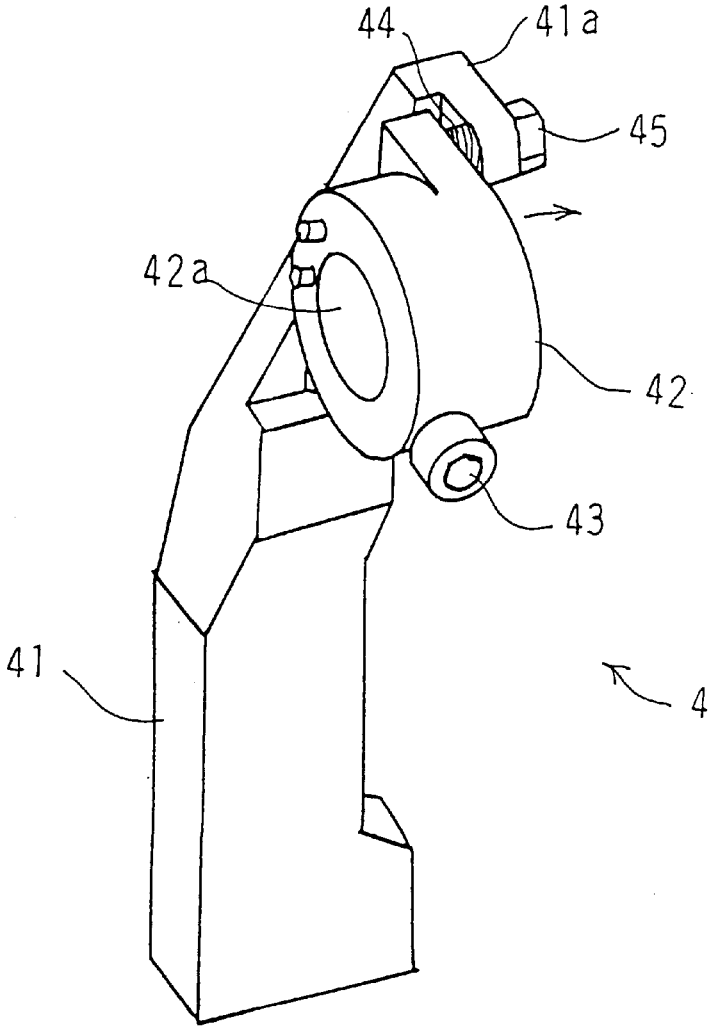
FIG. 18 is a perspective view showing a drill thinning pedestal.

FIG. 18 is a perspective view showing a state that the drill thinning pedestal 4 is constituted by mounting the fitting portion 42 to the fixing leg 41, and the fixing leg 41 and the fitting portion 42 are united by inserting a screw 43 into the through hole 42*c* and fitting it into the tapped hole 41*c*. For this reason, the fitting portion 42 can revolve in a direction of an arrow about the screw 43. However, the revolving angle in the direction of the whetstone is regulated by an adjustable screw 44 fitted into the tapped hole 41*b* provided in the extended portion 41*a* of the fixing leg 41.

A projecting length of the adjustable screw 44 to the direction of the fitting portion 42 can be adjusted by adjusting a position of a nut 45, and thus an oblique angle of the fitting portion 42 to the direction of the whetstone can be also adjusted within a predetermined range, and this adjustment of the oblique angle enables a thinning depth to be adjusted.

The drill thinning pedestal 4 is constituted so that when the drill holder 5 to which the drill is mounted is inserted into the fitting hole 42*a*, the center line of the drill is slanted through an angle of 20° with respect to an end surface of the whetstone 1, and a central portion of the point of the drill comes in contact with a boundary portion between the slanted surface 13 and second parallel surface 14 of the whetstone 1. Moreover, a revolving movement of the fitting portion 42 is set so that the edge point of the drill comes in contact with the whetstone 1 with it being slanted about 16° from the horizontal position upward, and when the edge point of the drill is substantially horizontal, it contacts with the adjustable screw 44 so as to be stopped.

The following will describe the steps of grinding a drill using the drill abrasive apparatus having the above structure.

Figure 19:
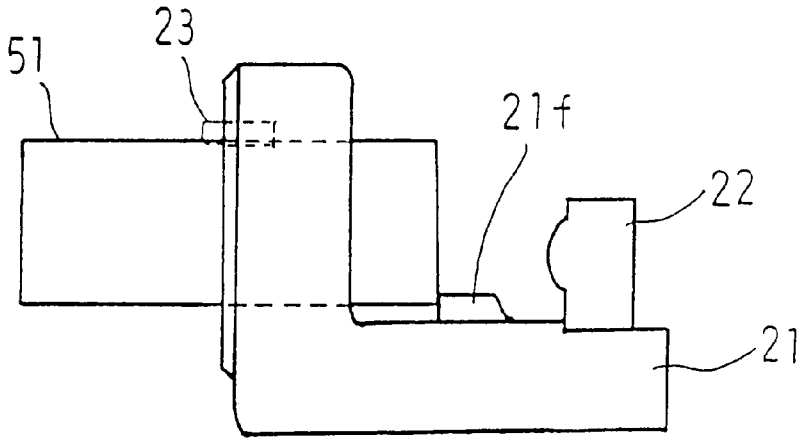
FIGS. 19 through 25 are explanatory drawings explaining steps of grinding a drill using the drill abrasive apparatus according to the present invention.

At first, the drill insertion portion 51 having the insertion hole 51*a* suitable to a diameter of a drill to be ground is selected, and the drill insertion portion 51 is inserted into the fitting hole 21*a* of the drill adjustable pedestal 2 until its end surface comes in contact with the projection 21*f* of the drill adjustable pedestal 2 (see FIG. 19).

Figure 20:
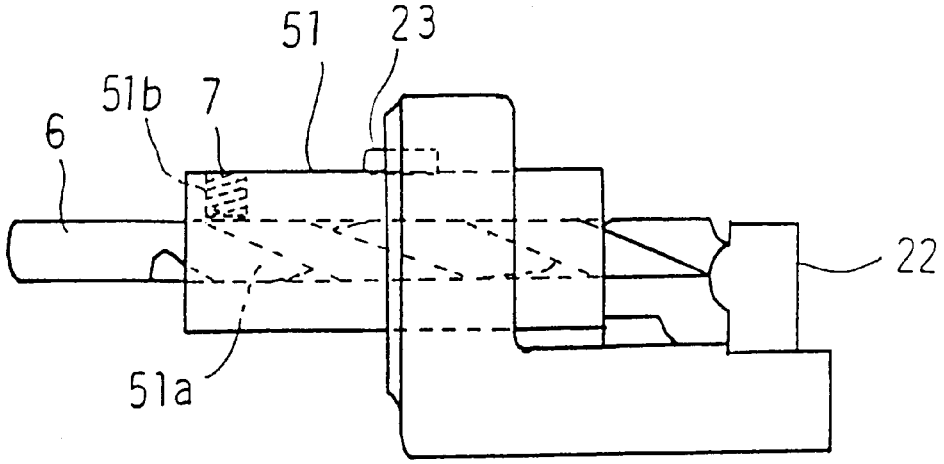

Next, a drill 6 is inserted into the insertion hole 51*a* of the drill insertion portion 51 until its point comes in contact with the stopper 22, and in this state the screw 7 is fitted into the tapped hole 51*b* so that the drill 6 is fixed to the drill insertion portion 51 (see FIG. 20).

Figure 21:
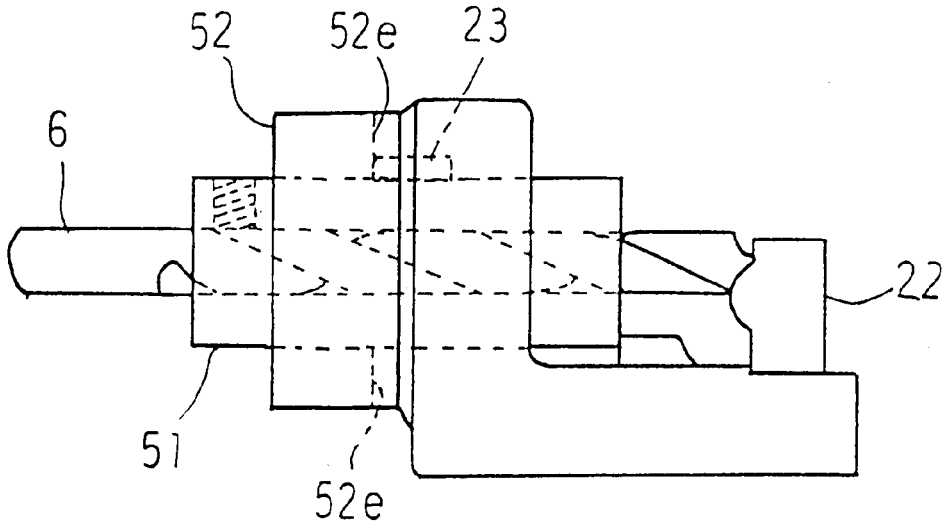
Figure 22:
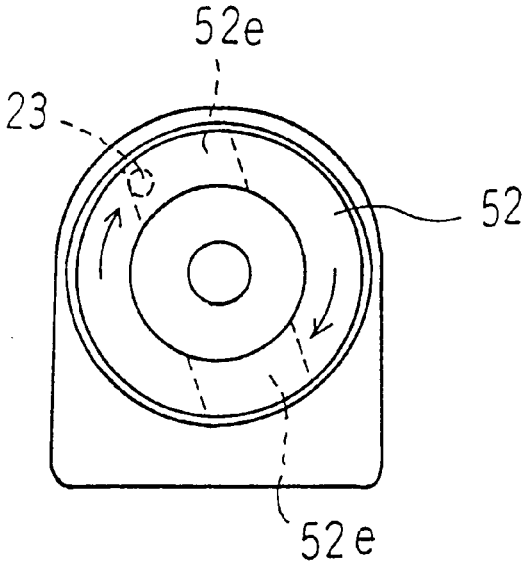

Thereafter, the drill insertion portion 51 is fitted into the holder ring 52 so that a pin 23 of the drill adjustable pedestal 2 is inserted into one of the guide groove 52*e* of the holder ring 52 (see FIG. 21). Then, the holder ring 52 and drill 6 are revolved right until it is stopped so that one side wall of the guide groove 52*e* is brought into contact with the pin 23 (see FIG. 22). In this state the fixing screws are fitted into the tapped holes 52*b* and 52*d* of the holder ring 52, and the drill 6 is located so as to be fixed to the drill holder 5.

Figure 23:
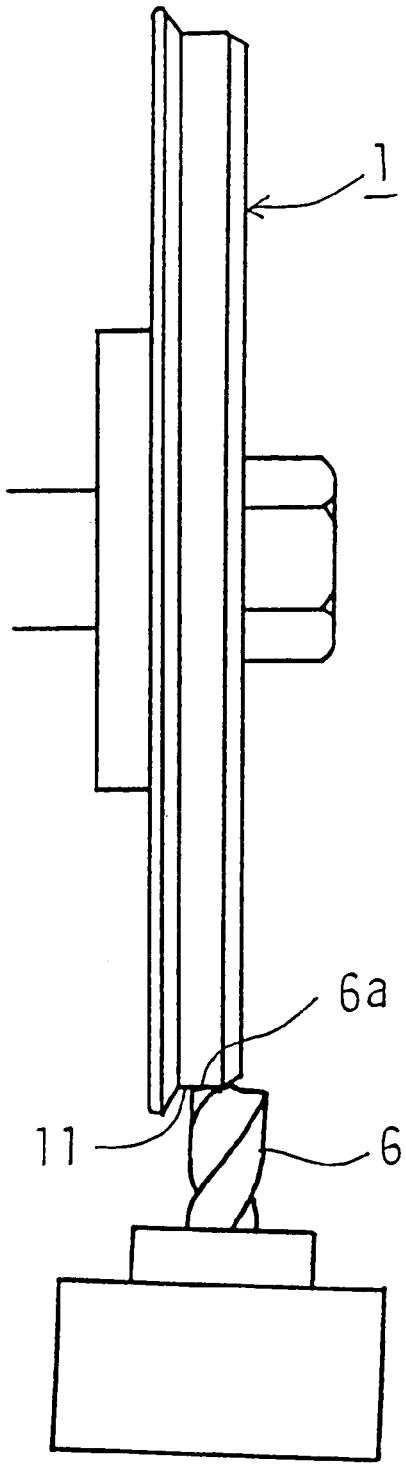

Next, the drill insertion portion 51 of the drill holder 5, where the drill 6 is located and fixed, is inserted into the fitting hole 31 of the drill abrasive pedestal 3, and the latch projection 31*a* of the drill abrasive pedestal 3 is inserted into the one of the guide groove 52*e* of the holder ring 52 with a play existing therebetween. As a result, a cutting edge 6*a* of the drill 6 comes in contact with the parallel surface 11 of the whetstone 1 as shown in FIG. 23, and one side of the cutting edge 6*a* is ground by the rotation of the whetstone 1. At this time, the cutting edge 6*a* is ground until the latch projection 31*a*, which is in contact with the one side wall of the guide groove 52*e*, comes in contact with the other side wall of the guide groove 52*e* by rotating the holder ring 52. Since the rotating range of the holder ring 52, namely, the drill 6 is regulated by the guide groove 52*e* and latch projection 31*a* in such a manner, only a predetermined portion of the cutting edge 6*a* can be ground accurately.

When the abrasion of the one side of the cutting edge 6*a* is completed, the drill holder 5 is removed from the fitting hole 31 of the drill abrasive pedestal 3 and is revolved through an angle of 180° so as to be again inserted into the fitting hole 31. Then, the latch projection 31*a* is inserted into the other guide groove 52*e* with a play existing therebetween, and the same operation is performed so that the other side of the cutting edge 6*a* is ground.

When the abrasion on the drill abrasive pedestal 3 is completed, the drill holder 5 is removed from the fitting hole 31 of the drill abrasive pedestal 3 and is inserted into the fitting hole 42*a* of the drill thinning pedestal 4. At this time, the two latch projections projected from the peripheral edge portion of the fitting hole 42*a* are put into the guide grooves 52*e* of the holder ring 52, and the side surfaces of the two latch projections are brought into contact with both the side walls of the guide groove 52*e*. As a result, the drill holder 5 is located with respect to the fitting portion 42 of the drill thinning pedestal 4.

Figure 24:
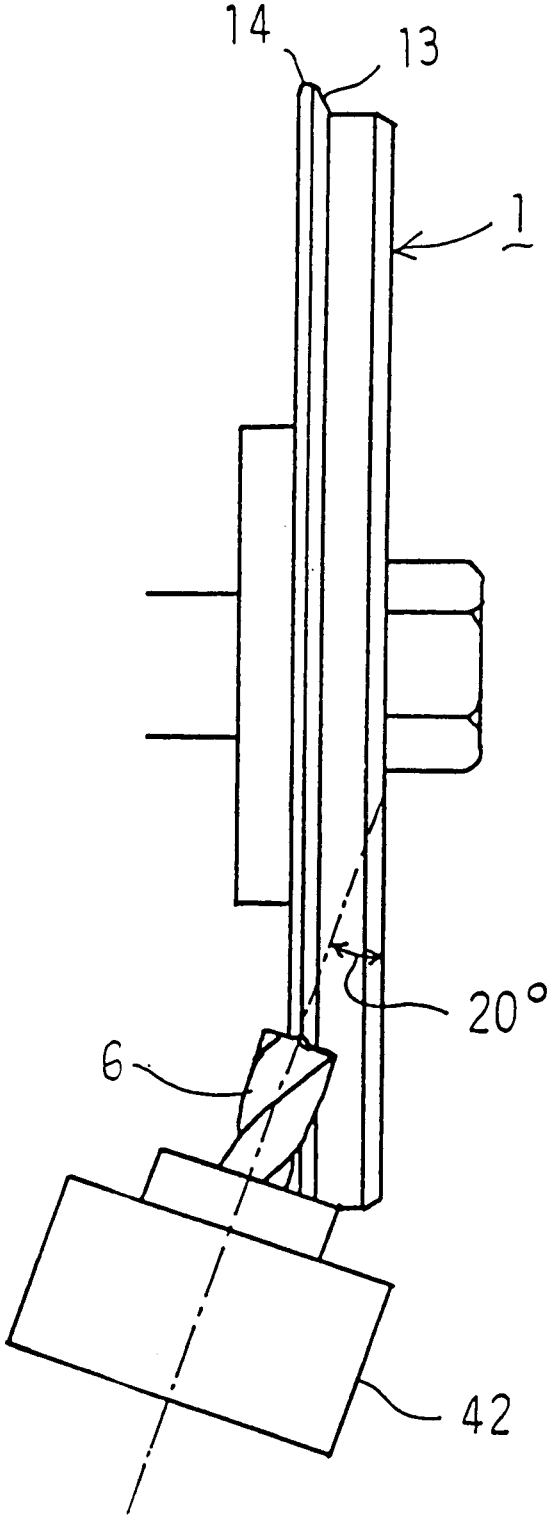

In this state, as shown in FIG. 24, the center line of the drill 6 is slanted 20° with respect to the end surface of the whetstone 1, and the center portion of the point of the drill contacts with the boundary portion between the slanted surface 13 and second parallel surface 14 of the whetstone 1.

Figure 25:
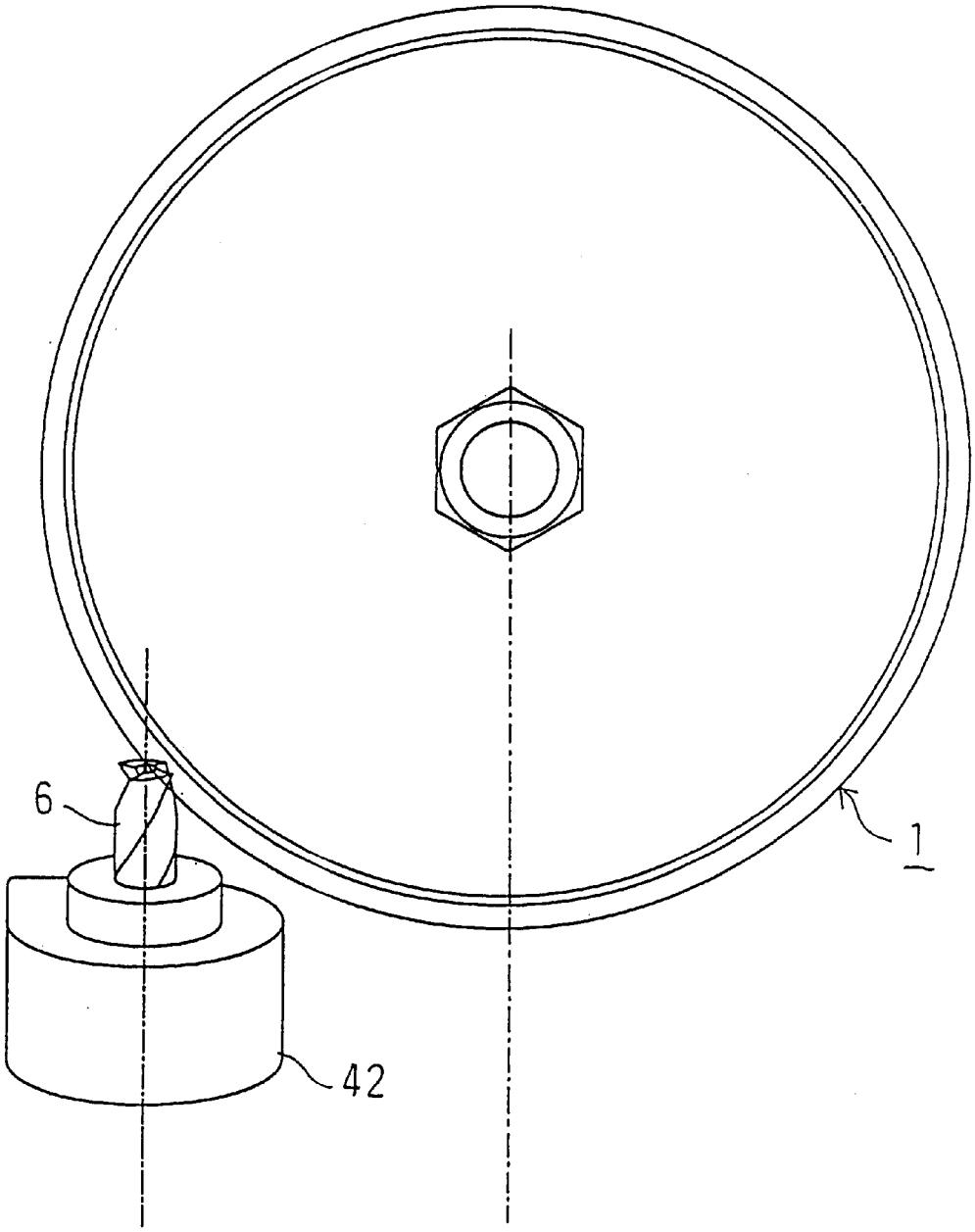

When the fitting portion 42 in this state is revolved to the direction of the whetstone 1 about the screw 43, the edge point of the drill 6, which is slanted about 16° from the horizontal position upward, comes in contacts with the whetstone 1 so that the abrasion is started. Next, when the fitting portion 42 is further revolved to the direction of the whetstone 1, the edge point of the drill 6 becomes substantially horizontal (see FIG. 25) and the end surface of the fitting portion 42 comes in contact with the adjustable screw 44 so as to be stopped. Then, the abrasion of the one side of the cutting edge (thinning process) is completed.

When the abrasion of the one side of the cutting edge is completed, the drill holder 5 is removed from the fitting hole 42*a* of the drill thinning pedestal 4 and is revolved through an angle of 180° so as to be again inserted into the fitting hole 42*a*. The latch projection 31*a* is inserted into the other guide groove 52*e* with a play existing therebetween, and the same operation is performed so that the abrasion (thinning process) of the other side of the cutting edge is executed.

Figure 26:
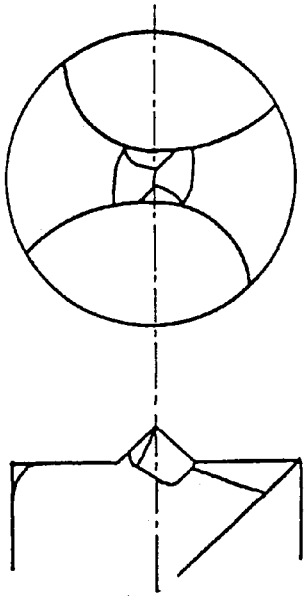
FIG. 26 is a drawing showing the drill where Z-type thinning is formed.
Figure 27:
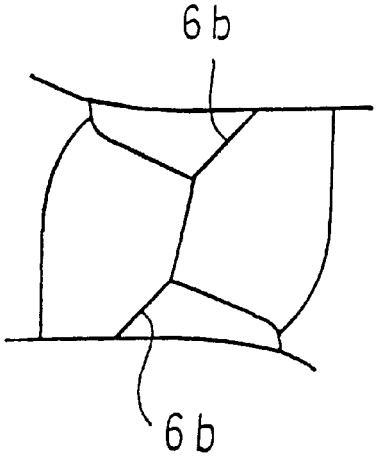
FIG. 27 is an enlarged view showing a thinned portion.
Figure 28:
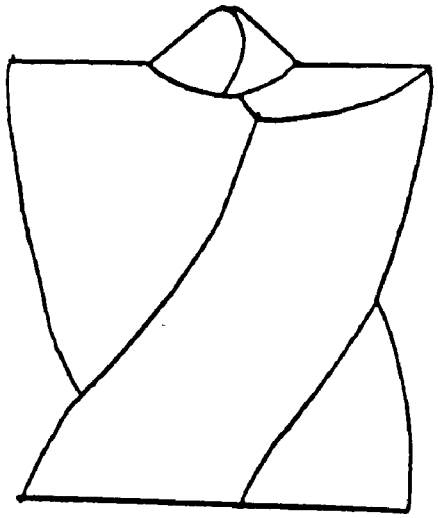
FIG. 28 is drawing showing the candle-shaped drill.

The Z-type thinning shown in FIG. 26 is formed at the point of the drill by the above-mentioned sequence of the operations. FIG. 27 is an enlarged drawing showing the thinned portion.

The drill formed by the Z-type thinning can execute stable cutting because the cutting edge 6*b* at the central portion has a straight-linear shape as shown in the drawing, and since the cutting edge 6*b* becomes parallel with an axial center of the drill, this drill becomes an ideal drill having sharpness and strength.

INDUSTRIAL APPLICABILITY

As mentioned above, the drill abrasive apparatus according to the present invention is capable of grinding a candle-shaped drill which requires Z-type thinning applicable to various uses such as removal of spot-welding to be used for a body panel or the like of a vehicle.

What is claimed is:

1. A drill abrasive apparatus which is capable of grinding a candle-shaped drill requiring Z-type thinning, characterized by comprising a whetstone (1), a drill holder (5), a drill adjustable pedestal (2), a drill abrasive pedestal (3) and a drill thinning pedestal (4), wherein an abrasive surface of said whetstone is composed of a parallel surface (11) formed parallel with a rotating axis of said whetstone, a relief surface (12) for a chisel portion at a central portion of the drill formed in front of said parallel surface, a slanted surface (13) for a thinning process formed behind said parallel surface so as to have a predetermined angle, and a second parallel surface (14) formed behind said slanted surface so as to be parallel with the rotating axis of said whetstone, said drill holder is composed of a cylindrical drill insertion portion (51), and a holder ring (52) which has a guide groove (52*e*) for regulating a rotating angle of said drill holder and is mounted to one end of the drill insertion portion so as to have a cutting edge-shape, said drill adjustable pedestal is composed of a fitting hole (21*a*) into which the drill insertion portion can be fitted, an adjustable base pedestal (21) having a latch projection for determining an angle and position of said drill holder, and a stopper (22) which is mounted on a forward side of the fitting hole so as to be integral with the adjustable base pedestal, said drill abrasive pedestal is composed of a fitting hole (31) into which the drill insertion portion can be fitted and when the drill insertion portion is inserted into the fitting hole until the holder ring of said drill holder comes in contact with a peripheral edge portion of the fitting hole, the cutting edge of the drill comes in contact with the abrasive surface of said whetstone and a latch projection (31*a*), which is inserted into the guide groove with a play existing therebetween, is provided on the peripheral edge portion, said drill thinning pedestal is composed of a fixing leg (41) fixed to a base (8) and a fitting portion (42) which is mounted to the fixing leg and has a fitting hole (42*a*) into which the drill insertion portion can be fitted, said fitting portion has a latch projection for determining the angle and position of said drill holder and can be slanted towards said whetstone within a predetermined angle range.

* * * * *